US006184798B1

(12) United States Patent
Egri

(10) Patent No.: US 6,184,798 B1
(45) Date of Patent: Feb. 6, 2001

(54) UNIDIRECTIONAL TELEMETRY SYSTEM

(75) Inventor: Robert Egri, Wayland, MA (US)

(73) Assignee: The Whitaker Corporation, Wilmington, DE (US)

( * ) Notice: Under 35 U.S.C. 154(b), the term of this patent shall be extended for 0 days.

(21) Appl. No.: 09/050,819

(22) Filed: Mar. 30, 1998

Related U.S. Application Data

(60) Provisional application No. 60/042,216, filed on Mar. 31, 1997.

(51) Int. Cl.[7] ..... G08C 15/08

(52) U.S. Cl. ..... 340/870.13; 340/870.03; 340/870.1; 246/169 A; 246/182 R

(58) Field of Search ..... 340/870.13, 870.1, 340/870.15, 531, 521, 870.03; 246/169 A, 169 R, 182 R

(56) References Cited

U.S. PATENT DOCUMENTS

| | | | | |
|---|---|---|---|---|
| 3,676,875 | * | 7/1972 | Adams et al. | 340/870.03 |
| 4,316,175 | | 2/1982 | Korber et al. | 246/169 A |
| 4,340,886 | | 7/1982 | Boldt et al. | 340/682 |
| 4,356,475 | * | 10/1982 | Neumann et al. | 340/521 |
| 4,442,426 | | 4/1984 | Heuschmann et al. | 340/539 |
| 4,582,280 | * | 4/1986 | Nichols et al. | 246/182 R |
| 4,724,435 | * | 2/1988 | Moses et al. | 340/870.13 |
| 5,272,476 | * | 12/1993 | McArthur | 340/870.13 |
| 5,374,015 | | 12/1994 | Bezos et al. | 246/169 R |
| 5,377,938 | | 1/1995 | Bezos et al. | 246/167 R |
| 5,383,717 | | 1/1995 | Fernandez et al. | 303/3 |
| 5,446,451 | | 8/1995 | Grosskopf, Jr. | 340/682 |
| 5,537,397 | | 7/1996 | Abramson | 370/441 |
| 5,539,396 | * | 7/1996 | Mori | 340/870.13 |
| 5,594,871 | * | 1/1997 | Hiyama | 340/870.13 |

FOREIGN PATENT DOCUMENTS

| | | | |
|---|---|---|---|
| 0627841 A2 | 5/1994 | (EP) | H04M/11/00 |
| 2297663 | 8/1996 | (GB) | H04M/11/00 |

OTHER PUBLICATIONS

PCT International Application No.: PCT/US95/03911, dated Oct. 12, 1995; International Publication No.: WO 95/27272.

PCT International Search Report, International application No.: PCT/US98/06204, International filing dated Mar. 30, 1998.

* cited by examiner

*Primary Examiner*—Michael Horabik
*Assistant Examiner*—Albert K. Wong
(74) *Attorney, Agent, or Firm*—Brian K. Dinicola

(57) ABSTRACT

A telemetry system comprises a plurality of beacons. Each beacon repetitively transmits a packet having a first predetermined time duration. The beacon transmits the packet a first predetermined number of iterations. A monitoring receiver observes for the transmitted packets within each of a plurality of time slots. Each slot has second predetermined time duration. The first predetermined time duration is less than the second predetermined time duration.

15 Claims, 3 Drawing Sheets

Pr(250,R,8)
Pr(250,R,16)
Pr(350,R,32)
Pr(350,R,16)
Pr(500,R,24)

UNIDIRECTIONAL TELEMETRY SYSTEM

This application claims benefit to U.S. Provisional Application 60/042,216 filed Mar. 31, 1997.

FIELD OF THE INVENTION

The present invention relates to telemetry systems and more particularly to telemetry systems for remote data acquisition.

BACKGROUND OF THE INVENTION

Telemetry systems used for remote data monitoring are known in a variety of different applications including "Local LAN" Systems for example hospital record keeping, and "Body LAN", for example monitoring soldier biological vital signs in a battlefield situation. Conventionally, data telemetry employs a bi-directional communications link wherein both a network controller and transmitting sensors each operate as transponders. Conventional telemetry systems include time and frequency division multiplexing systems. In a conventional telemetry system, the network controller receives a radio signal from the transmitting sensors and converts the signal to a digital format providing the measured data. The network controller also operates to transmit synchronization and/or acknowledgment information to the transmitting sensors. The transmitting sensors operate to receive the synchronization and/or acknowledgment information as well as to transmit the radio signal measured data. Accordingly, in a conventional telemetry system, the remote transmitting sensors also act as receivers and the central receiver also acts as a transmitter. The communication link between the central receiver and the transmitting sensors, therefore, is bi-directional and synchronously communicates, typically, in time or frequency or both.

U.S. Pat. No. 5,537,397 issued Jul. 16, 1996 entitled "Spread ALOHA For CDMA Data Communications" discloses a method of providing multiple access to a data communications channel wherein transmitters spread a data signal spectrum according to a code spreading sequence. In order to simplify the system by obviating the need for multiple receivers in a receiving hub for interpreting differently coded data transmissions, the hub station transmits a control signal which is received by the transmitters to advance or retard the timing of the data transmission in order to reduce the probability of fatal interference between two or more transmitted signals. Accordingly, the transmitters operate as transponders and a single receiver is able to receive the transmitted data serially. As can be appreciated by one of ordinary skill in the art, both the network controller and the transmitters operate as transponders. Disadvantageously, a transponder is more costly to implement and requires more power to operate than a pure transmitter. As the number of sensors to monitor increases, so does the cost and power required for implementation of a bi-directional telemetry system. There is a need, therefore, for a lower cost, lower power telemetry system, that maintains the robust transmission performance of the known synchronized and acknowledged telemetry systems.

SUMMARY OF THE INVENTION

It is an object of the present invention to provide a low cost monitoring system.

It is a further object of the present invention to provide a system for remote monitoring of a plurality of sensors from a single receiver.

It is a further object to provide a robust and reliable unidirectional telemetry system for remote data acquisition.

A telemetry system comprises a plurality of transmitters operating autonomously relative to each other, each transmitter transmitting a packet over a first predetermined transmit time duration. A monitoring receiver receives the packet within a second predetermined receive time duration. The first predetermined transmit time duration is less than the second predetermined receive time duration and there is an absence of an acknowledgment signal from the receiver to the transmitter.

It is a feature of the present invention that a plurality of beacons transmit data to a receiver and the beacons do not receive synchronization or acknowledgment information, thereby providing a lower cost telemetry system due to the exclusive transmit operation of the beacons.

Advantageously, a system according to the teachings of the present invention provides a low cost, robust, and reliable unidirectional telemetry system for remote monitoring of a plurality of sensors.

BRIEF DESCRIPTION OF THE DRAWINGS

Embodiments of the invention will now be described by way of example and with reference to the following drawings in which.

DETAILED DESCRIPTION OF THE PREFERRED EMBODIMENTS

A specific application that would benefit from a remote data collection telemetry system and the application specifically disclosed herein for purposes of illustration, is condition monitoring of wheel bearings on a railway car. Wheel bearing health of a railway car is of significant importance to train operation as well as safety. Typically, wheel bearings on a railway car are scheduled for preventative maintenance at predetermined time intervals in order to avoid a failure. Preventative maintenance of a wheel bearing involves decommissioning the railway car, disassembling the wheel bearings, cleaning portions of the bearings and replacing worn parts. If the preventative maintenance is performed more often than is necessary, the procedure is costly and train operations proceed less efficiently than what is theoretically possible. If the preventative maintenance is not performed often enough, there is an increased risk of unexpected wheel bearing failure and train derailment which is also costly. In order to achieve maximum efficiency and lowest costs, it is desirable for wheel bearing preventative maintenance to be performed only when needed and without increasing the likelihood of unexpected bearing failure. Other equally advantageous applications of the present invention include, but are not limited to, remote monitoring of utility meters, passive locations systems to retrieve stolen property, long term data collection, and data collection in locations that are difficult to access or otherwise monitor.

Figure 1:
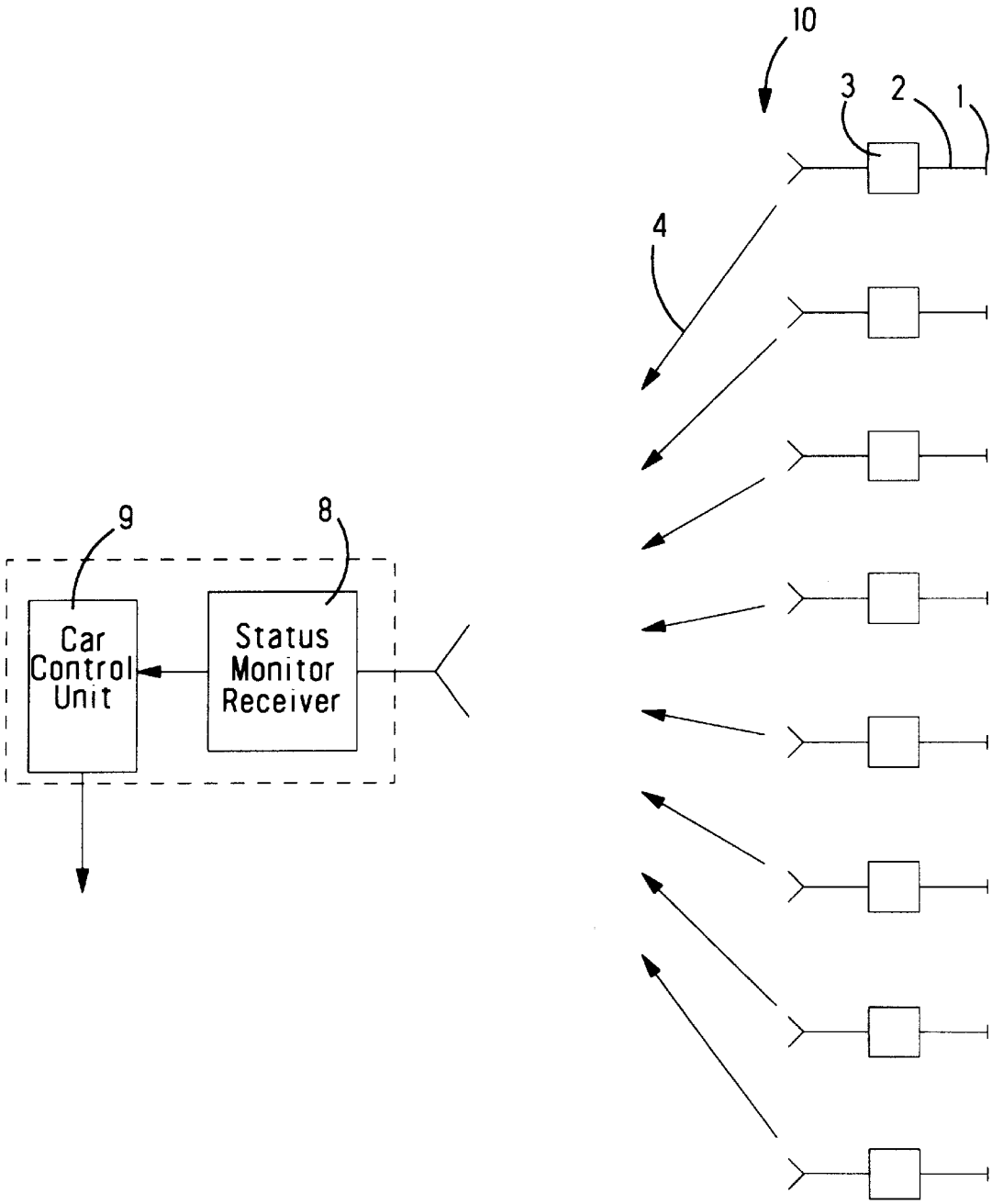
FIG. 1 is a block diagram of transmitting sensors and a status monitoring and car control unit receiver which together comprise a unit of a remote data acquisition system according to the teachings of the present invention.
Figure 2:
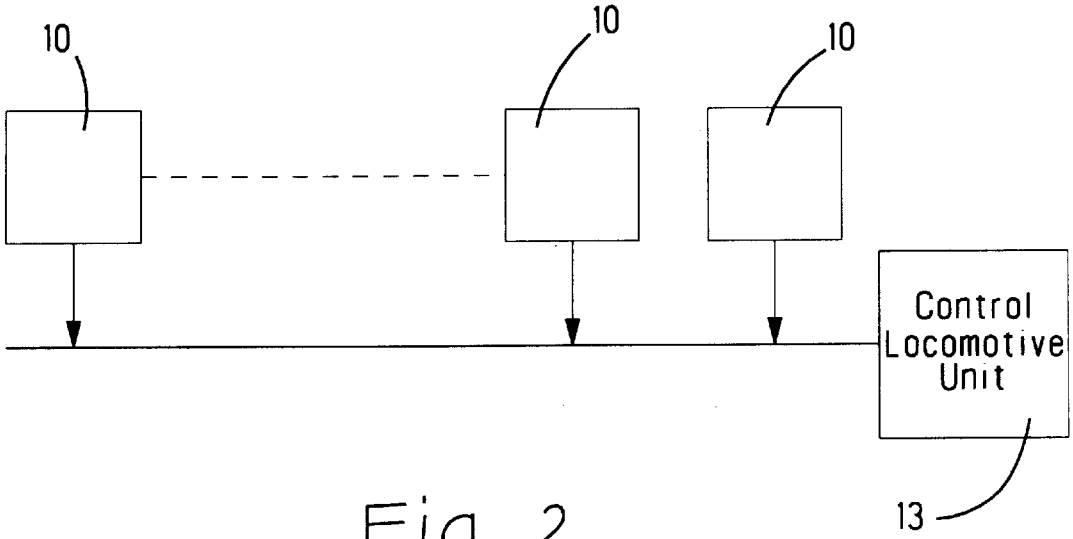
FIG. 2 is a block diagram of multiple remote data acquisition units as shown in FIG. 1 showing the relationship to a single central locomotive unit for use in a railroad car bearing monitoring system according to the teachings of the present invention.

With specific reference to FIGS. 1 and 2 of the drawings, there is shown a remote data acquisition unit comprising a plurality of sensors 1 communicating measured data to respective beacons 3. For the purposes of the present invention, "a beacon 3" is defined as a system element that performs a transmitting function, exclusively, and does not perform a receive function. In a preferred embodiment, the transmitted signals are radio frequency (RF) signals. In a preferred embodiment, each sensor 1 measures aspects of railroad car wheel bearing health including but not limited to: temperature, vibration, and revolutions per unit time. Each bearing has one or more sensors 1 associated therewith. Each sensor 1 or group of sensors is associated with at least one of the beacons 3, to which the sensor 1 transmits measured data. Each sensor 1 transmits measured data via a suitable interconnect 2 such as copper wire to the respective beacon 3.

Each railway car is equipped with one monitoring receiver 8 for receiving signals transmitted by the beacons 3. The beacon 3 comprises sufficient intelligence to interpret and packetize the measured data from the sensor 1. The beacon 3 interprets, packetizes and converts the data to a radio frequency (RF) signal for wireless transmission to a monitoring receiver 8. Accordingly, the monitoring receiver 8 passively receives or observes the RF signals transmitted by the plurality of beacons 3 associated with a single railway car. The monitoring receiver 8 does not transmit any synchronization or acknowledgment information to the beacons 3. The term "observes" in the context of the present invention refers to reception of a transmitted signal and an absence of a transmitted signal back to the transmitters for purposes of synchronization or acknowledgment.

The monitoring receiver 8 assembles and sends data received from all of the beacons 3 to a car control unit 9, also on the railway car, over a suitable interconnect such as copper wire. The monitoring receiver 8 and car control unit 9 are physically a single piece of equipment. The car control unit 9 communicates over the wire using any conventional bi-directional and synchronized link to a locomotive control unit 13 which is physically housed in the train engine. Each railway car is equipped with one car control unit 9 communicating with the monitoring receiver 8. A plurality of receivers 8 and car control units 9 are associated with a respective plurality of railroad cars that together comprise a single train. All of the car control units 9 communicate with a locomotive control unit 13 (LCU). With all bearing data for a given amount of time consolidated in the single LCU 13, the LCU processes the data and either alerts train personnel concerning the status of one or more wheel bearings, or may initiate some form of automated control over train functions such as procedures to stop the train if sensor readings indicate an imminent failure.

Operation of the remote data acquisition unit 10 is as follows. Each beacon 3 contains electronic intelligence to receive and packetize data measured by the sensor 1. Each beacon 3, operating independently of every other beacon 3 and asynchronously with the receiver, transmits the packetized data in a signal burst 4 for reception by the monitoring receiver 8 via a unidirectional wireless link. The signal burst 4 occurs over a first predetermined transmit time duration. The beacon 3 employs a conventional radio frequency transmission link for data transfer, each beacon 3 transmitting a signal having the same nominal carrier frequency within manufacturing, aging, and temperature tolerances. The receiver 8 observes all transmitted signals in contiguous units of time or receive time frames 15, T seconds in duration. Each receive time frame 15 is further delineated into a plurality M, of equal length time slots 16, each time slot 16 being T/M seconds in duration, which is a second predetermined receive time duration 16. The signal burst 4 containing the packet of data is no more than and preferably approximately equal to one half of the time slot 16 in duration. In other words, the first predetermined transmit time duration is less than or equal to and preferably approximately one half of the second predetermined receive time duration. Within a predetermined transmission frame, each beacon 3 repetitively transmits the packet 4, a plurality, R, iterations. Each of the R iterations is transmitted at intervals that are distributed uniformly random over the predetermined transmission frame and independent of packet bursts 4 transmitted by other beacons 3.

Figure 3:
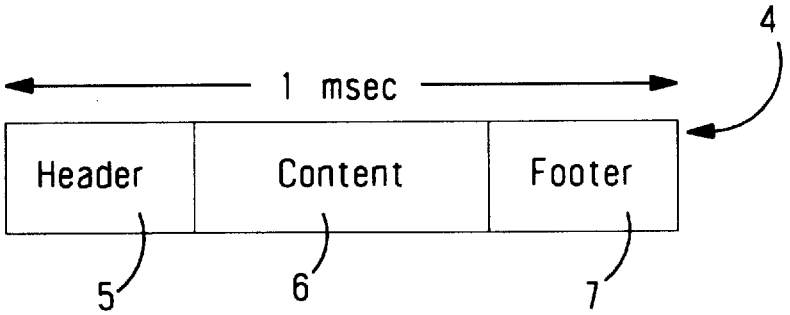
FIG. 3 is a block diagram of a preferred embodiment of a data packet used to transmit measured data in a remote data acquisition system according to the teachings of the present invention.
Figure 4:
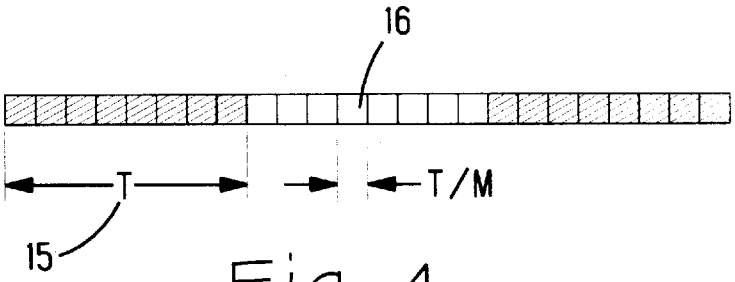
FIG. 4 is a block diagram of observation time slots and frames employed by the status monitoring receiver according to the teachings of the present invention.

With specific reference to FIG. 3 of the drawings, a single packet 4 comprises a 100 Kbit/sec signal having a duration of 1 msec or 100 bits total. The packet 4 further comprises a header 5 having X synchronization bits and Y bits identifying the transmitting beacon 3/sensor 1. Z bits of content 6, contain a value representing the respective sensor measurement at an instant in time. The packet 4 further comprises a footer 7 containing W parity bits which are used to determine whether the packet 4 was received without collision or error by the receiver 8. In an embodiment of the invention, there may be a plurality of sensors 1 associated with a single beacon 3. In the alternative embodiment, there is a single header 5 and footer 7 at the beginning and end respectively of each packet 4. The content 6, however, includes identification and measurement data for each sensor with which the beacon 3 is associated. If the parity bits in the footer 7 indicate an error, the packet 4 is discarded by the receiver 8. A request for retransmission is not sent to the beacon 3 upon detection of the error. Nor is an acknowledgment (ACK) sent to the beacon 3 to indicate successful reception of the data by the receiver 8. When two or more packets 4 from different beacons 3 collide, the resulting interference between the signals at the receiver 8 causes nonreception of the packet involved in the collision for the time slot 16. Because the beacons 3 perform a transmission function exclusively, the receiver 8 does not indicate to the beacon 3 the reception versus nonreception of data and the data is lost. A monitoring system for certain applications such as this one, however, can tolerate a certain number of lost transmissions without adversely effecting system performance. In particular, a monitoring system wherein the measurements taken do not change rapidly over time as compared to a time interval within which transmission may be assured with acceptable probability, loss of data at infrequent intervals does not affect system performance. In the event that a sensor 1 measures an out of tolerance condition, the beacon 3 can adjust the priority of transmission. The beacon 3 receives the sensor measurement, and if the magnitude of the measurement is either above or below a given set of thresholds reflecting an out of tolerance condition, the beacon 3 increases the frequency of transmission for the out of tolerance sensor to reduce the probability of data loss. The receiver then interprets the information transmitted by the beacon 3 and reports the out of tolerance condition to the car control unit for further processing.

Figure 5:
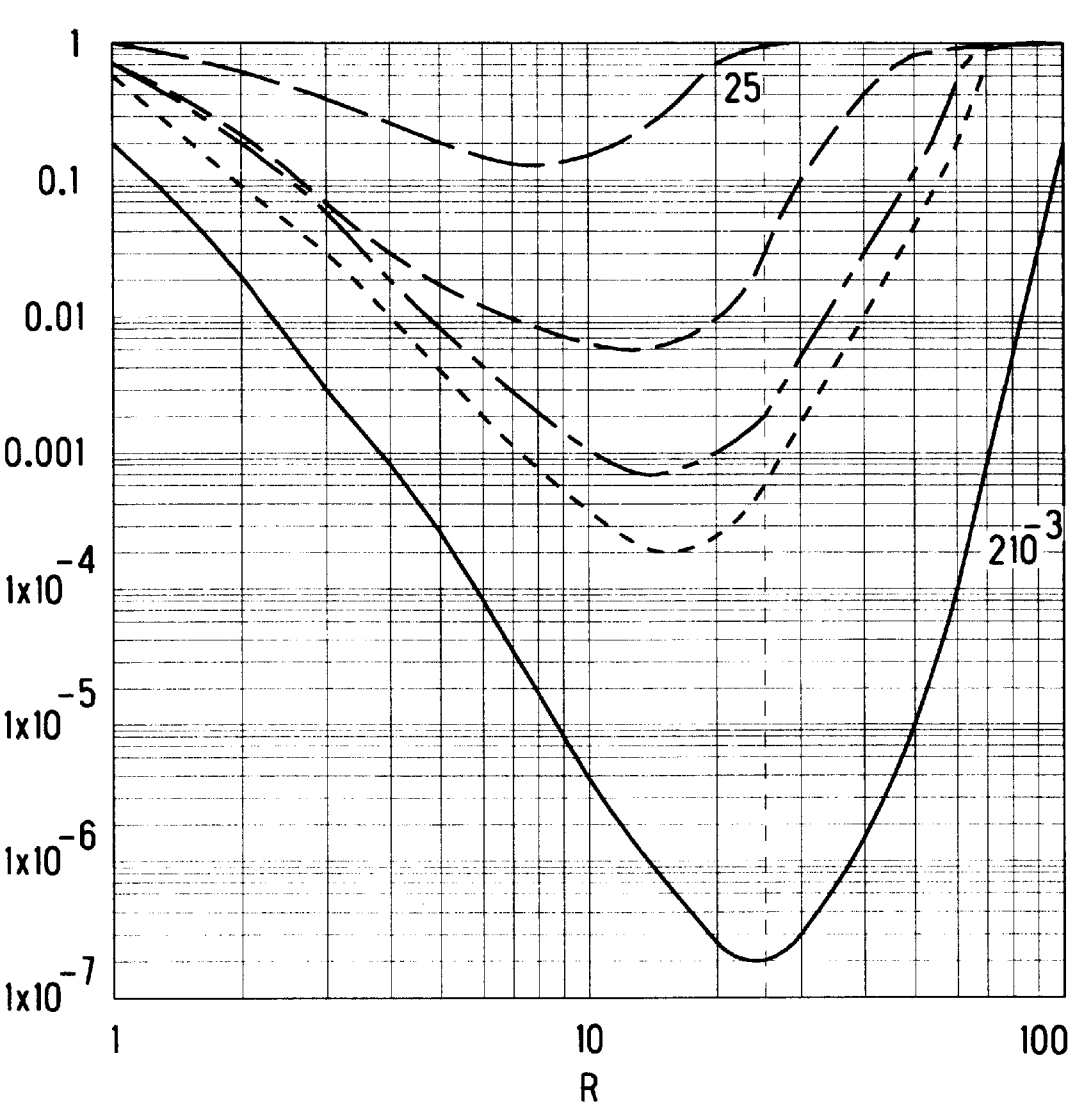
FIG. 5 is a graphical representation of probability curves showing an upper bound of the probable loss of reception of a data packet as a function of system parameters.

With specific reference to FIG. 5 of the drawings, there is shown a graphical representation of a probability of loss of all repetitions of a packet burst 4 transmitted by one of the beacons 3 for all time slots 16 of duration M in a single receive time frame 15 of duration T. Probability curves are shown for a number of beacons, B, and a number of slots, M, in a frame 15 as a function of the number of repetitions, R, of the packet burst 4 over the frame 15. The probability curves Pr(B,R,M) shown assume that each beacon 3 transmits randomly and independently of the remaining beacons, but with the same number of repetitions over a transmission frame. As can be appreciated by one of ordinary skill in the art, for a given number of beacons and slots per frame, a repetition rate for any one packet burst 4 may be selected for the lowest probability of losing all repetitions of one of the packet bursts 4 for the frame 15.

In an embodiment of a telemetry system wherein a measurement taken by one sensor 1 either changes more rapidly than others or for some other reason is more critical to system performance, one or more of the beacons 3 may be assigned a higher number of repetitions to be transmitted per frame 15. A lower priority sensor transmits fewer bursts 4 per frame 15 relative to a higher priority sensor 1 which transmits a relatively greater number of bursts 4 per frame 15. A telemetry system, therefore, may be optimized for a specific application and for specific kind of measurements.

Other advantages of the invention are apparent from the detailed description by way of example, and from spirit and scope of the appended claims.

What is claimed is:

1. A unidirectional telemetry system comprising:

a monitoring receiver operative to receive transmitted packets over successive frames, each frame being constituted by a plurality of equal length time slots, without acknowledging receipt of any of said transmitted packets; and a plurality of beacons, each beacon including a transmitter operative to transmit packets autonomously relative to any transmitter of any other beacon, and each transmitter being operative to transmit packets asynchronously relative to said monitoring receiver;

wherein each said transmitter is operative to transmit a given packet a plurality of times within a corresponding frame, with each packet transmitted by a respective transmitter being transmitted within any one of said time slots and retransmitted at random times within said corresponding frame;

wherein random collisions between packets transmitted and retransmitted by corresponding transmitters occur during a frame, a frequency of random packet retransmission being selected in accordance with packet length and total number of transmitters to obtain a sufficiently small probability of jamming as to ensure receipt by said monitoring receiver of information contained in each transmitted packet; and wherein no beacon receives an acknowledgement that any transmitted packet has been received by said monitoring receiver.

2. The telemetry system of claim 1, further including a plurality of sensors, each respective sensor being operative to periodically perform a predetermined measurement and each respective sensor being operative to supply a signal representative of performed measurement data to one of said plurality of transmitters whereby information relating to a performed measurement may be transmitted to said monitoring receiver.

3. The telemetry system of claim 1, wherein at least one transmitter receives measurement data from multiple sensors.

4. The telemetry system of claim 2, wherein at least one of said plurality of sensors has a tolerance range wherein a transmitter associated with said at least one sensor repeats a transmitted packet representative of data measured by said at least one sensor more frequently during a frame than if data measured is outside of said tolerance range.

5. The telemetry system of claim 2, wherein each sensor has a priority level assigned thereto which is known by an associated transmitter and wherein an associated transmitter adaptively repeats data from a sensor having a higher priority level more often over a frame than data from a sensor having a lower priority level.

6. The telemetry system of claim 1, wherein each transmitter is operative to transmit each packet within approximately one-half of a time slot.

7. A telemetry system for use in monitoring wear in moving parts of a locomotive, comprising:

at least one car control unit including a monitoring receiver operative to receive transmitted packets communicating performed measurements over successive frames, each frame being constituted by a plurality of equal length time slots, without acknowledging receipt of any of said transmitted packets;

a plurality of beacons associated with said at least one car control unit, each beacon including a transmitter operative to transmit packets autonomously relative to any transmitter of any other beacon, and each transmitter being operative to transmit packets asynchronously relative to said monitoring receiver; and a plurality of sensors associated with said at least one car control unit, each respective sensor being operative to periodically perform a predetermined measurement and each respective sensor being operative to supply a signal representative of a performed measurement to a corresponding one of said plurality of transmitters;

wherein each said transmitter is operative to transmit a given packet a plurality of times within a corresponding frame, with each packet transmitted by a respective transmitter being transmitted within any one of said time slots and retransmitted at random times within said corresponding frame;

wherein random collisions between packets transmitted and retransmitted by corresponding transmitters occur during a frame, a frequency of random packet retransmission being selected in accordance with packet length and total number of transmitters to obtain a sufficiently small probability of jamming as to ensure receipt by said monitoring receiver of information contained in each transmitted packet; and wherein no beacon receives an acknowledgement that any transmitted packet has been received by said monitoring receiver.

8. The telemetry system of claim 7, wherein at least one transmitter receives measurement data from multiple sensors.

9. The telemetry system of claim 7, wherein at least one of said plurality of sensors has a tolerance range wherein a transmitter associated with said at least one sensor repeats a transmitted packet representative of data measured by said at least one sensor more frequently during a frame than if data measured is outside of said tolerance range.

10. The telemetry system of claim 7, wherein each sensor has a priority level assigned thereto which is known by an associated transmitter and wherein an associated transmitter adaptively repeats data from a sensor having a higher priority level more often over a frame than data from a sensor having a lower priority level.

11. The telemetry system of claim 7, wherein each transmitter is operative to transmit each packet within approximately one-half of a time slot.

12. The telemetry system of claim 7, further including a locomotive control unit, said locomotive unit being operative to receive signals representative of said sensor measurements from each of a plurality of car control units, each respective car control unit being associated with a corresponding locomotive car and being operative to report sensor measurements associated with said corresponding locomotive car.

13. A method of monitoring wear in a locomotive, comprising the steps of:

providing in at least one car, a monitoring receiver operative to receive transmitted packets communicating performed measurements associated with said at least one car over successive frames, each frame being constituted by a plurality of equal length time slots, without acknowledging receipt of any of said transmitted packets;

providing a plurality of beacons associated with said at least one car, each beacon including a transmitter operative to transmit packets autonomously relative to any transmitter of any other beacon, and each transmitter being operative to transmit packets asynchronously relative to said monitoring receiver;

providing a plurality of sensors associated with said at least one car, at least some of said sensors being operative to periodically perform a predetermined measurement of one of temperature, vibration, and wheel revolutions per unit of time;

supplying signals representative of measurements performed by said plurality of sensors to said plurality of transmitters; and transmitting to the monitoring receiver, using the transmitters, packets containing measurement data collected by said plurality of sensors, each packet being transmitted a plurality of times within a corresponding frame, with each packet transmitted by a respective transmitter being transmitted within any one of said time slots and retransmitted at random times within said corresponding frame;

wherein during said transmitting step, random collisions between packets transmitted and retransmitted by corresponding transmitters occur during a frame, a frequency of random packet retransmission being selected in accordance with packet length and total number of transmitters to obtain a sufficiently small probability of jamming as to ensure receipt by the monitoring receiver of information contained in each transmitted packet; and wherein no beacon receives an acknowledgement that any transmitted packet has been received by the monitoring receiver.

14. The method of claim 13, further including a step of receiving from the monitoring receiver, at a locomotive control unit, signals representative of measurements associated with the at least one car.

15. The method of claim 14, further including a step of generating an alarm to alert maintenance personnel to a need to service a component monitored by one of the sensors.

* * * * *